US011125399B1

(12) United States Patent
Zarcone et al.

(10) Patent No.: US 11,125,399 B1
(45) Date of Patent: Sep. 21, 2021

(54) CONNECTION FOR SCALABLE LED LUMINAIRE TAPE

(71) Applicant: APOGEE LIGHTING HOLDINGS, LLC, Deer Park, NY (US)

(72) Inventors: Frank Zarcone, Smithtown, NY (US); Michael Boyd, Sayville, NY (US)

(73) Assignee: APOGEE LIGHTING HOLDINGS, LLC, Deer Park, NY (US)

( * ) Notice: Subject to any disclaimer, the term of this patent is extended or adjusted under 35 U.S.C. 154(b) by 0 days.

(21) Appl. No.: 16/889,386

(22) Filed: Jun. 1, 2020

(51) Int. Cl.

| | |
|---|---|
| ***F21S 4/24*** | (2016.01) |
| ***F21S 2/00*** | (2016.01) |
| ***F21V 23/06*** | (2006.01) |
| ***F21V 23/00*** | (2015.01) |
| *F21Y 103/10* | (2016.01) |
| *F21Y 115/10* | (2016.01) |

(52) U.S. Cl.
CPC ..... *F21S 4/24* (2016.01); *F21S 2/005* (2013.01); *F21V 23/005* (2013.01); *F21V 23/06* (2013.01); *F21Y 2103/10* (2016.08); *F21Y 2115/10* (2016.08)

(58) Field of Classification Search
CPC ..... F21S 4/24; F21S 2/005; F21V 23/06
See application file for complete search history.

(56) References Cited

U.S. PATENT DOCUMENTS

| | | | |
|---|---|---|---|
| 4,173,035 | A | 10/1979 | Hoyt |
| 4,984,999 | A | 1/1991 | Leake |
| 5,848,837 | A | 12/1998 | Gustafson |
| 5,927,845 | A | 7/1999 | Gustafson et al. |
| 6,074,074 | A | 6/2000 | Marcus |
| 6,673,292 | B1 | 1/2004 | Gustafson et al. |
| 7,034,230 | B2 | 4/2006 | Fan |
| 7,259,030 | B2 | 8/2007 | Daniels et al. |
| 8,052,303 | B2 | 11/2011 | Lo et al. |
| 8,262,250 | B2 | 9/2012 | Li et al. |
| 8,641,229 | B2 | 2/2014 | Li |
| 8,704,448 | B2 | 4/2014 | Tischler et al. |
| 9,109,765 | B2 | 8/2015 | Rieger |

(Continued)

FOREIGN PATENT DOCUMENTS

| | | |
|---|---|---|
| CN | 101587883 | 11/2009 |
| CN | 104633507 | 5/2015 |
| EP | 2562470 | 2/2013 |

OTHER PUBLICATIONS www.yhledlight.com/High-Voltage-SMD5050-60led-m-LED-Strip-Light-pd6370072.html, Shenzhen Better Technology Ltd., 2011.
https://www.ledsmagazine.com/horticultural-lighting/agriculture-aquaculture/article/16695282/properties-of-led-light-can-boost-poultry-production-and-profits-magazine, Jun. 2014.
https://web.archive.org/web/20160318194003/http://www.onceinnovations.com/agriculture-lighting, Jan. 2015.

(Continued)

*Primary Examiner* — Evan P Dzierzynski
(74) *Attorney, Agent, or Firm* — Tutunjian & Bitetto, P.C.

(57) ABSTRACT

A lighting device includes a substrate, an electrical circuit operably coupled to the substrate, a connector block operably coupled to the substrate and in electrical communication with the electrical circuit, and a casing disposed over the substrate, the electrical circuit, and the connector block. A portion of the casing defines a contact surface. The contact surface and a portion of the substrate define a cavity therebetween. A portion of the contact surface of the casing abuts a corresponding portion of the connector block to provide mechanical support to a joint formed between a portion of connector block and a portion of the substrate.

20 Claims, 9 Drawing Sheets

(56) References Cited

U.S. PATENT DOCUMENTS

| | | | | |
|---|---|---|---|---|
| 9,228,732 | B2 * | 1/2016 | Li | F21S 4/28 |
| 9,491,821 | B2 | 11/2016 | Shackle | |
| 9,671,075 | B2 | 6/2017 | Greene | |
| 9,746,144 | B1 | 8/2017 | Greene | |
| 2002/0174995 | A1 | 11/2002 | Southard et al. | |
| 2008/0239716 | A1 * | 10/2008 | Lin | F21S 4/26 362/219 |
| 2010/0008090 | A1 * | 1/2010 | Li | F21S 4/24 362/249.03 |
| 2011/0180818 | A1 | 7/2011 | Lerman et al. | |
| 2013/0107526 | A1 | 5/2013 | Ishibashi et al. | |
| 2014/0091335 | A1 | 4/2014 | Satake et al. | |
| 2014/0334142 | A1 * | 11/2014 | Levante | F21V 23/06 362/222 |
| 2015/0031140 | A1 | 1/2015 | Seddigi et al. | |
| 2017/0030536 | A1 * | 2/2017 | Kramer | F21S 4/22 |
| 2018/0031190 | A1 * | 2/2018 | Nicolai | F21S 4/24 |

OTHER PUBLICATIONS https://web.archive.org/web/20160401182438/https://www.diodeled.com/products/strip-lights.html, Apr. 2016.

GM Lighting, LEDTASK™ 12VDC Standard Output Wet Location Flexible LED Linear Ribbon, Specification Sheet, 2014.

https://web.archive.org/web/20160323132626/http://www.opticarts.com/new-page-1/, Jan. 2016.

FLEX ACv2, Optic Arts Specification Sheet, Mar. 8, 2019.

InvisiLED® Pro 2, 24V LED Tape Light, WAC Lighting, Specification Sheet, Feb. 2016.

GeoLite®, Warm-On-Dim 2700K—2200K 2V AC LED Tape Light, Lynk Labs, Product Data Sheet, May 7, 2016.

http://www.cbconcept.com/120VLEDSMD3528Rope-CW.aspx, CBConcept, website, Internet Archive Wayback Machine, Dec. 2012.

www.ledsmagazine.com/company-newsfeed/article/16692613/elumina-shows-led-lighting-systems-at-hk-lighting-fair, LEDs Magazine, Elumina Technology, Aug. 2007.

* cited by examiner

CONNECTION FOR SCALABLE LED LUMINAIRE TAPE

TECHNICAL FIELD

The present disclosure relates generally to lighting devices, and, in particular, to a connection for scalable light emitting diode (LED) luminaire tape.

BACKGROUND

Flexible printed circuits or flexible printed circuit boards are increasingly being utilized due to their ability to conform to various shapes, flex during use, more easily fit in confined spaces, etc. Flex circuits incorporate flexible printed circuits by mounting various electronic devices thereon, such as light emitting diodes (LEDs), resistors, capacitors, etc. As can be appreciated, the flexible nature of the substrate of the flex circuits may cause the components disposed thereon to become disconnected when subjected to strain. This property becomes troublesome when utilizing interconnect components, such as connectors, which are frequently subjected to external forces.

SUMMARY

The present disclosure relates to a lighting device including a substrate, an electrical circuit operably coupled to the substrate, a connector block operably coupled to the substrate and in electrical communication with the electrical circuit, and a casing disposed over the substrate the electrical circuit, and the connector block. A portion of the casing defines a contact surface. The contact surface and a portion of the substrate define a cavity therebetween. A portion of the contact surface of the casing abuts a corresponding portion of the connector block to provide mechanical support to a joint formed between a portion of the connector block and a portion of the substrate.

In accordance with another aspect of the present disclosure, a method of manufacturing a lighting device includes forming a first extrusion over a portion of a substrate, the substrate including an electrical circuit operably coupled to the substrate and a connector block operably coupled to the substrate and in electrical communication with the electrical circuit, and forming a second extrusion within the channel. The second extrusion defines a contact surface wherein the contact surface and a portion of the substrate define a cavity therebetween. A portion of the contact surface of the casing abuts a corresponding portion of the connector block to provide mechanical support to a joint formed between a portion of the connector block and a portion of the substrate.

In accordance with yet another aspect of the present disclosure, a method of using a lighting device includes identifying a desired length of an electrical circuit, severing the electrical circuit at a circuit repeat joint operably coupled to the electrical circuit corresponding to the desired length, where at least a portion of each severed portion of the electrical circuit is encapsulated by a first extrusion forming a channel, electrically coupling a respective connector block operably coupled to each of the severed electrical circuits to electrically couple each of the severed electrical circuits across a gap defined therebetween, and mechanically supporting at least one connector block using a second extrusion formed within the channel.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiments below, serve to explain the principles of the disclosure, wherein.

DETAILED DESCRIPTION

Figure 1:
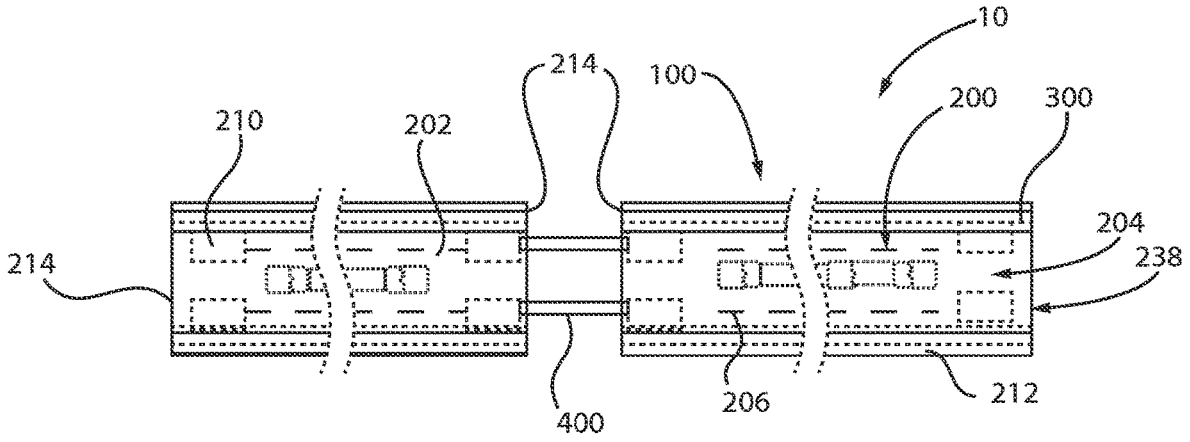
FIG. 1 is plan view of a lighting device provided in accordance with the present disclosure.

The present disclosure is directed to a lighting device. As described herein, the lighting device can include a luminaire tape having a casing having a base and a cover. The base of the casing partially encapsulates each electrical circuit disposed on a corresponding substrate and defines a channel. The cover is formed within the channel of the base and includes a lower surface that defines a cavity between the lower surface and a portion of each electrical circuit. The lower surface of the cover abuts a portion of a connector block operably coupled to the substrate and in electrical communication with the electrical circuit to provide mechanical support to each connector block and inhibit damage to a joint formed between a portion of the connector block and a portion of the substrate. The lower surface of the cover may include an arcuate surface, the profile of which may vary to alter the propagation of light therethrough that is emitted from a plurality of LEDs associated with each electrical circuit. The base and the cover may be formed separately or may be formed concurrently using a co-extrusion process.

The connector blocks enable severing of the luminaire tape at a desired location and electrical coupling of the severed portions of the luminaire tape to another portion of luminaire tape or a junction box. In this manner, portions of luminaire tape located around corners or other difficult to navigate configurations can be electrically coupled by selectively coupling each respective connector block via an electrical wire. In embodiments, the luminaire tape may be electrically coupled to a junction box using an electrical wire selectively coupled to a respective connector block of the luminaire tape and a terminal block associated with the junction box.

Embodiments of the present disclosure are now described in detail with reference to the drawings in which like reference numerals designate identical or corresponding elements in each of the several views. In the drawings and in the description that follows, terms such as front, rear, upper, lower, top, bottom, and similar directional terms are used simply for convenience of description and are not intended to limit the disclosure. In the following description, well-known functions or constructions are not described in detail to avoid obscuring the present disclosure in unnecessary detail.

Referring now to the drawings, a lighting device is illustrated and generally identified by reference numeral 10. As illustrated in FIG. 1, the lighting device 10 includes a luminaire tape 100 having a plurality of electrical circuits 200 and a cover or jacket 300.

The electrical circuit 200 includes a substrate 202 formed from any suitable material capable of supporting a plurality of electrical components of the electrical circuit 200 thereon. In one non-limiting embodiment, the substrate 202 can be flexible. In embodiments, the substrate 202 may be formed from polymeric materials such as polyimide, polyether ether ketone (PEEK), polyester, flexible silicon, polyethylene terephthalate (PET), composites (fiberglass, carbon fiber, prepreg, or the like), etc. The electrical circuit 200 includes a printed circuit 204 disposed on the substrate 202 that is configured to electrically communicate with one or more of a plurality of electrical components integrated within the electrical circuit 200, as will be described in further detail hereinbelow. It is contemplated that the printed circuit 204 may be disposed on or within the substrate 202 using any suitable means. In one non-limiting embodiment, the printed circuit 204 is silk screened or deposited and etched into the substrate 202.

The electrical circuit 200 includes a plurality of electrical components in electrical communication with the printed circuit 204. The electrical circuit 200 can be stepped and repeated along an entire length of the luminaire tape 100. In this manner, the electrical circuit 200 includes a bus 206 which can be Alternating Current (AC) or Direct Current (DC), a plurality of micro light engines 208, and a plurality of connector blocks 210.

Continuing with FIG. 1, the bus 206 is segmented into a plurality of sections 212, each connected to a respective micro light engine of the plurality of micro light engines 208 and to respective connector blocks of the plurality of connector blocks 210, as will be described in further detail hereinbelow. It is contemplated that the plurality of sections 212 may be any suitable length, and in embodiments, each section of the plurality of sections 212 may be the same or different lengths. In one non-limiting embodiment, the length of each section of the plurality of sections 212 is four inches. As can be appreciated, each section of the plurality of sections 212 includes a circuit repeat joint 214 where a wattage and associated lumen output of associated LEDs of a micro light engine 208 can scale from fractions of a watt to thousands of watts by cutting the luminaire tape 100 to a desired length at a circuit repeat joint 214.

Figure 3:
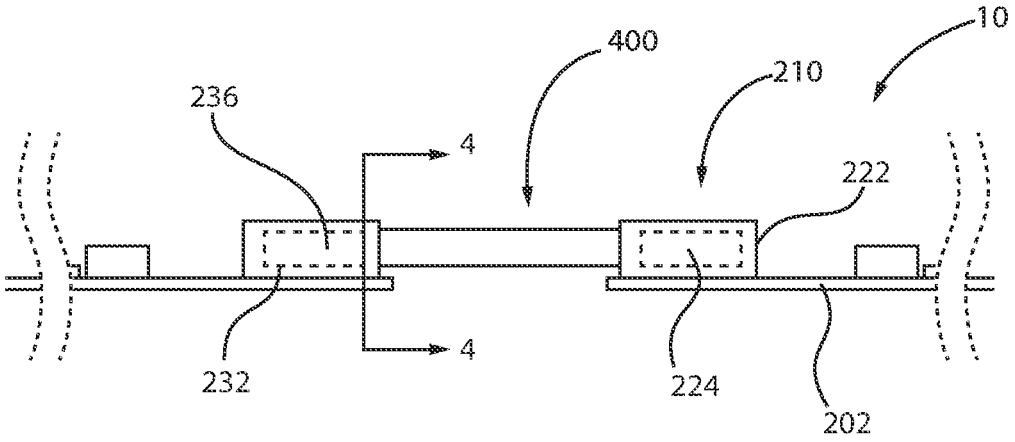
FIG. 3 is an elevation view of the lighting device of FIG. 1.
Figure 4:
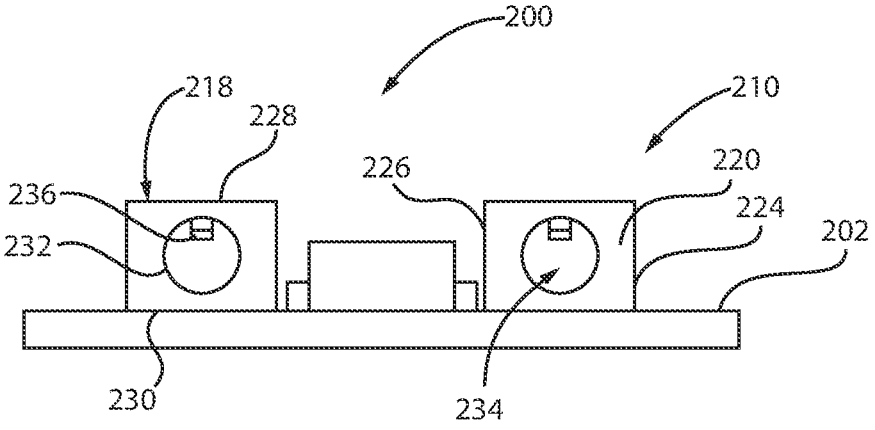
FIG. 4 is a side, cross-sectional view of the lighting device of FIG. 1 taken along section line 4-4 of FIG. 3.
Figure 5:
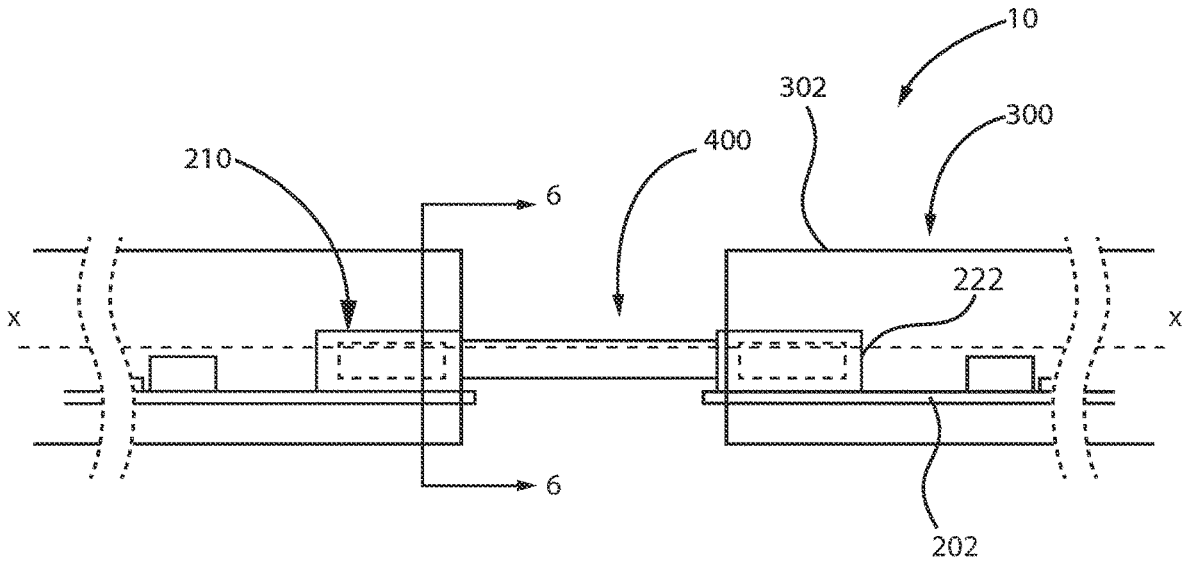
FIG. 5 is an elevation view of the lighting device of FIG. 1 showing a casing.
Figure 6:
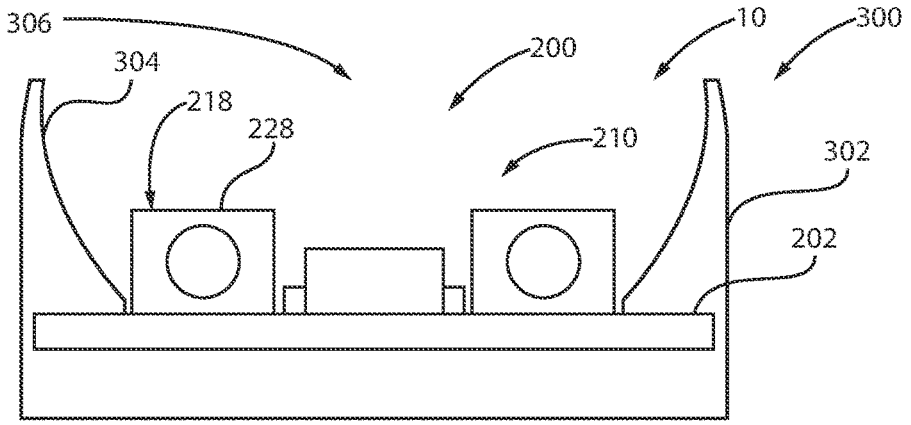
FIG. 6 is a side, cross-sectional view of the lighting device of FIG. 5 taken along section line 6-6 of FIG. 5.
Figure 7:
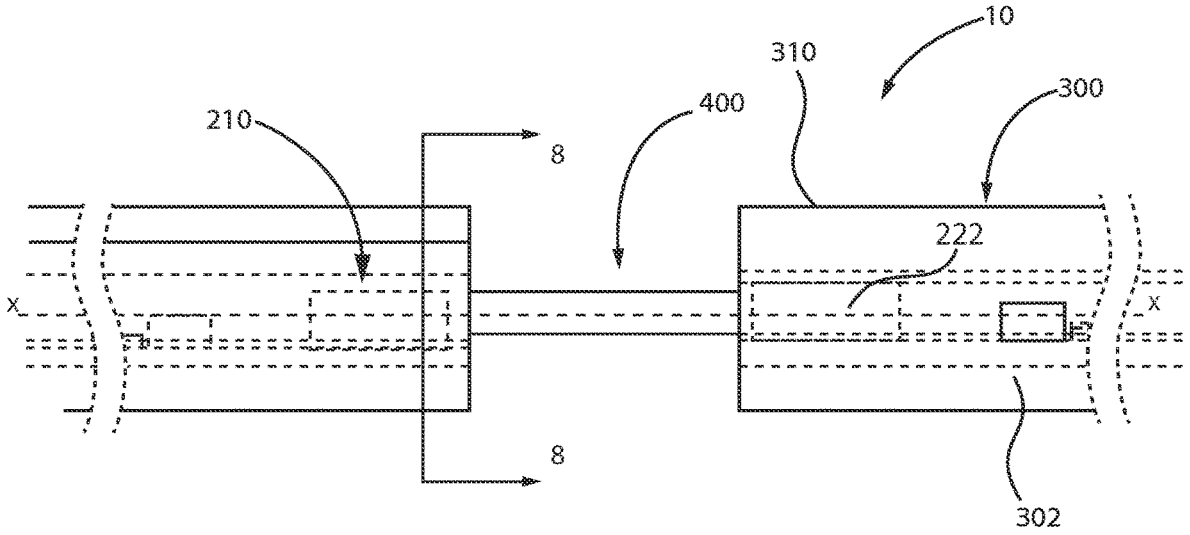
FIG. 7 is an elevation view of the lighting device of FIG. 5.

With continued reference to FIG. 1, and additional reference to FIGS. 3 and 4, each section of the plurality of sections 212 includes a plurality of connector blocks 210 disposed thereon and in electrical communication with the bus 206. Each connector block of the plurality of connector blocks 210 is substantially similar and therefore only one connector block 210 will be described in detail herein in the interest of brevity.

The connector block 210 may be a mechanical connector configured to selectively retain a portion of an electrical wire, a pin, etc. therein. In this manner, the connector block 210 defines a housing 218 having opposed end surfaces 220 and 222, opposed side surfaces 224 and 226 extending between each end surface of the opposed end surfaces 220, 222, and top and bottom surfaces 228 and 230 disposed in juxtaposed relation to one another and extending between each of the opposed end surfaces 220, 222 and opposed side surfaces 224, 226. The connector block 210 includes an inner surface 232 defining a bore 234 that extends through the end surface 220. The bore 234 is configured and dimensioned to selectively receive a portion of an electrical wire, a pin, etc. therein. In one non-limiting embodiment, the bore 234 is configured to receive an 18 American Wire Gauge (AWG) electrical wire, although it is contemplated that any suitable electrical wire capable of transmitting electrical energy may be utilized. It is envisioned that the housing 218 may be formed from any suitable material having the mechanical, dielectric, and/or electrical properties capable of being utilized in electrical circuits, such as a non-metallic material, a metallic material, a ceramic, etc. Although generally illustrated has having a rectangular configuration, it is contemplated that the housing 218 may include any suitable configuration, such as ovate, spherical, cuboid, etc.

In one illustrated embodiment, a resilient finger 236 is hingedly disposed on a portion of the inner surface 232 of the bore 234 and is configured to permit a portion of the electrical wire, pin, etc. to be received within the bore 234 and selectively inhibit the received electrical wire, pin, etc. from being removed therefrom. As can be appreciated, the resilient finger 236 may be any suitable device capable of selectively retaining the electrical wire, pin, etc. therein and may be formed from any suitable material having the mechanical, electrical, and/or conductive properties capable of conducting electrical energy, such as steel, aluminum, gold, copper, etc. Although generally described as being a resilient finger, it is contemplated that the resilient finger 236 may be a plurality of resilient fingers, one or more tabs, a retaining ring, etc. In embodiments, the resilient finger 236 may be integrally formed with the housing 218, may be a separate component therefrom, or combinations thereof. Although generally described as being monolithically formed, it is contemplated that the connector block 210 may be formed using any suitable process, such as being machined from a solid material, injection molding, stamping, waterjet, laser cutting, 3-D printing, etc.

The connector block 210 may be coupled to the bus 206 using any suitable method, such as soldering, mechanical connection, etc. In one non-limiting embodiment, the connector block 210 is a surface mount connector configured to be soldered or otherwise secured to a portion of the substrate 202. It is contemplated that the connector block 210 may be any suitable connector capable of selectively retaining an electrical wire, a pin, etc. therein. In one non-limiting embodiment, the connector block 210 may be an open frame poke in connector, such as those manufactured by AVX Corporation™ (AVX®).

Referring again to FIG. 1, each leg of the bus 206 includes a connector block 210 in electrical communication therewith and disposed in spaced relation relative to one another (e.g., disposed towards opposed side surfaces of the section 212. Each connector block 210 is disposed on the substrate 202 at each end of the section 212 such that the end surface 220 of the housing 218 of the connector block 210 is set back from or otherwise spaced from an end surface 238 of the section 212 (e.g., towards an interior portion of the section 212). In embodiments, the end surface 220 of the connector block 210 may be flush with or extend past the end surface 238 of the section 212.

With reference to FIG. 3 and FIG. 1, as can be appreciated, the plurality of connector blocks 210 enable multiple sections 212 of the luminaire tape 100 that have been separated from one another to be electrically coupled via an electrical wire 400 (e.g., a jumper, a pin, etc.). In this manner, the luminaire tape 100 may be separated at a circuit repeat joint 214 to expose respective connector blocks of the plurality of connector blocks 210 disposed on each portion of the separated sections 212. A pair of electrical wires 400 may be inserted into each exposed connector block 210 of the respective sections 212 such that electrical energy may be transmitted from one section 212 to the other section 212. As can be appreciated, the electrical wires 400 may be any suitable length depending upon the location and orientation of each of the sections 212 relative to one another. An electrical wire 400 may be utilized to electrically couple the two sections 212 through respective connector blocks 210, thereby enabling the luminaire tape 100 of the lighting device 10 to be installed around tight corners or other difficult to navigate configurations.

In embodiments, the plurality of connector blocks 210 enable a section 212 of the luminaire tape 100 that has been separated to be electrically coupled to a junction box 700 (FIGS. 11-13) via an electrical wire 400 (e.g., a jumper, a pin, etc.), as will be described in further detail hereinbelow.

Figure 2:
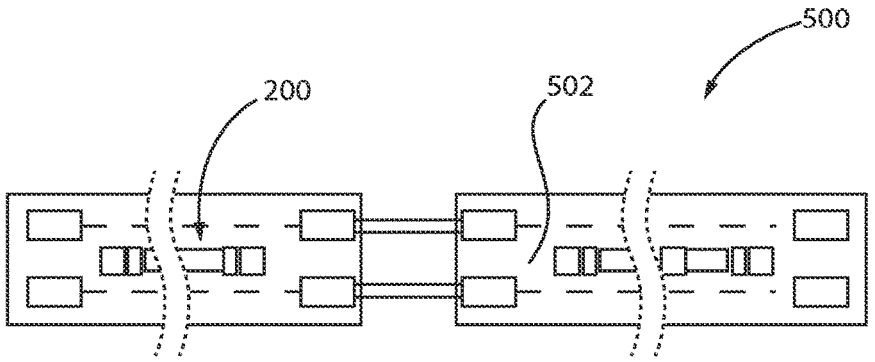
FIG. 2 is a plan view of another embodiment of a lighting device provided in accordance with the present disclosure.

With reference to FIG. 2, an alternate embodiment of the luminaire tape is illustrated and generally identified by reference numeral 500. The luminaire tape 500 is substantially similar to the luminaire tape 100 and therefore only the differences therebetween will be described herein in the interest of brevity.

The luminaire tape 500 includes a rigid substrate or printed circuit board 502 on which the electrical circuit 200 is disposed. It is envisioned that the rigid substrate 502 may be formed from any suitable material using any suitable process, such as synthetic resin bonded paper (FR-2), glass-reinforced epoxy laminate (RF-4), aluminum, etc. and silk screen printing, photoengraving, PCB milling, laser etching, etc.

Returning to FIG. 1 and with additional reference to FIGS. 5-8, the casing 300 is disposed over the electrical circuit 200. Although generally illustrated as fully enclosing the electrical circuit 200, it is contemplated that the casing 300 may partially enclose the electrical circuit 200, intermittently enclose the electrical circuit 200, or combinations thereof.

The casing 300 includes a first extrusion or base 302 defining a generally cuboid profile, although it is contemplated that the base 302 may include any suitable profile, such as ovoid, spheroid, cone, etc. The base 302 encompasses a portion of the substrate 202 of the electrical circuit 200 and includes an inner surface 304 defining a channel 306 extending along a longitudinal axis X-X (FIG. 5) defined through the luminaire tape 100. In this manner, the base 302 retains the substrate 202 therein and the channel 306 is configured such that the electrical components of the electrical circuit 200 is in open communication therewith.

It is contemplated that the base 302 may be formed using any suitable process capable of encapsulating the portions of the substrate 202 and the electrical components of the electrical circuit 200 along a length thereof, such as extruding, over molding, etc. In one non-limiting embodiment, the base 302 is extruded over the portions of the substrate 202 and the electrical components of the electrical circuit 200.

The casing 300 includes a second extrusion or cover 308 configured to be received within the channel 306 of the base 302. The cover 308 defines a generally planar top surface 310 and an opposite, lower surface 312. The lower surface 312 defines a plurality of arcuate profiles which cooperate to inhibit movement of the plurality of connector blocks 210 relative thereto and relative to the substrate 202 and thereby inhibit damage to a joint formed between each of the plurality of connector blocks 210 and a corresponding portion of the substrate 202. The cover 308 is dimensioned such that when the cover 308 is received within the channel 306 of the base 302, the lower surface 312 of the cover 308 is spaced apart from the substrate 202 and the electrical components of the electrical circuit 200, such that a portion of the channel 308 remains as a cavity or the like. The lower surface 312 defines opposed side surfaces 314 and 316 having an arcuate profile. Although generally illustrated as having a concave profile, it is contemplated that the opposed side surfaces 314, 316 may include a convex profile, a linear profile, a sinusoidal profile, etc. The lower surface 312 defines a center surface 318 extending between the opposed side surfaces 314, 316 and having an arcuate profile having its apex or crown extending away from the top surface 310 (e.g., towards the substrate 202). Although generally illustrated as having a convex profile, it is contemplated that the center surface 318 may have any suitable profile, such as concave, linear, sinusoidal, etc.

Figure 8:
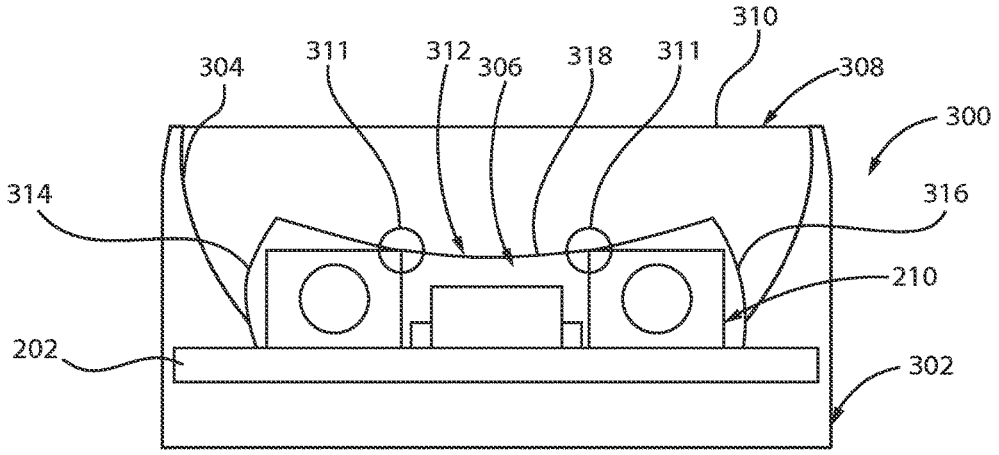
FIG. 8 is a side, cross-sectional view of the lighting device of FIG. 5 taken along section line 8-8 of FIG. 7.

Continuing with FIG. 8, the opposed side surfaces 314, 316 of the cover 308 are spaced apart from each respective connector block of the plurality of connector blocks 210 to permit limited movement of the substrate 202 and the electrical components of the electrical circuit 200 relative thereto and to enable the casing 300 to deform as it is manipulated or otherwise flexed by external forces. In this manner, as the luminaire tape 100 is manipulated or otherwise flexed by an external force, the channel 306 may be caused to be reduced in size such that the opposed side surfaces 314, 316 abut a portion of a respective connector block of the plurality of connector blocks 210. In embodiments, the opposed side surfaces 314, 316 may be configured to abut a portion of a respective connector block of the plurality of connector blocks 210 when the luminaire tape 100 is in a static position to inhibit movement of the plurality of connector blocks 210 relative to the substrate 202, the electrical components of the electrical circuit 200, the casing 300, or combinations thereof and thereby inhibit damage to a joint formed between a portion of each respective connector block 210 and a corresponding portion of the substrate 202.

The center surface 318 of the cover 308 is configured to abut a portion of each respective connector block of the plurality of connector blocks 210 to inhibit movement of each connector block of the plurality of connector blocks 210 relative to the substrate 202, the electrical components of the electrical circuit 200, the casing 300, or combinations thereof. In this manner, the center surface 318 abuts an upper corner 311 of each connector block of the plurality of connector blocks 210 to constrain movement and strain of each connector block of the plurality of connector blocks 210 and inhibit damage to the electrical joint between each connector block of the plurality of connector blocks 210 and the substrate 202, although it is contemplated that the center surface 318 may contact any suitable portion of the plurality of connector blocks 210 to constrain movement and strain thereof relative to the substrate 202. Although generally described as abutting or otherwise contacting each connector block of the plurality of connector blocks 210, it is contemplated that the center surface 318 of the cover 308 may be spaced apart from the plurality of connector blocks 210 such that a gap is formed therebetween to enable a predetermined amount of movement of the plurality of connector blocks 210 relative to the center surface 318 and/or the substrate 202, depending upon the design needs of the lighting device 10.

As can be appreciated, the geometry and/or profile of the center surface 318 of the cover 308 affects the transmission of light therethrough and propagation therefrom. In this manner, the profile of each of the opposed side surfaces 314, 316 and the center surface 318 may vary depending upon the design needs of the lighting device 10. In one non-limiting embodiment, the opposed side surfaces 314, 316 and the center surface 318 include profiles that disperse light from the casing 300 at an angle of up to approximately 145 degrees. In embodiments, one or more of the plurality of LEDs 216 (FIG. 9) may be oriented in various directions relative to the substrate 202 to cause the light emitted therefrom to propagate at specific angles from the casing 300. As can be appreciated, the profiles of each of the opposed side surfaces 314, 316 and the center surface 318 serve to mechanically constrain the plurality of connector blocks 210 in addition to defining the light transmission therethrough. In embodiments, one or both of the opposed side surfaces 314, 316, the center surface 318, or combinations thereof may include a reflective coating disposed thereon.

It is contemplated that the base 302 and the cover 308 may be formed from the same or different materials, and may be formed from any resilient material, such as a non-metallic material, a metallic material, a composite, etc. In embodiments, the cover 308 may be formed from a translucent or transparent material such that the light emitted from the plurality of LEDs 216 may be transmitted through the cover 308 and be externally visible. In embodiments, the cover 308 may be entirely translucent, entirely transparent, opaque with translucent and/or transparent windows, or combinations thereof. In one non-limiting embodiment, the cover 308 may be formed from polyvinyl chloride (PVC).

The base 302 may be formed from an opaque material to inhibit the transmission of light therethrough or from a translucent or transparent material such that light emitted from the plurality of LEDs 216 may be transmitted therethrough, depending upon the design needs of the lighting device 10. In one non-limiting embodiment, the cover 308 is formed from a translucent material and the base 302 is formed from an opaque material. In embodiments, the base 302 may be at least partially formed from a translucent material to enable light emitted from the plurality of LEDs 216 to propagate therethrough in addition to propagating through the cover 308. In this manner, the angle at which light is emitted from the casing 300 may be increased or decreased depending upon the amount of translucent material the base 302 is formed of.

It is contemplated that each of the base 302 and the cover 308 may be entirely or partially formed from a material conforming to UL 94 (Underwriter Laboratories 94) and/or UL 746C. In one non-limiting embodiment, the base 302 and the cover 308 are formed from a material having a UL 94 rating of 5VA (e.g., flame retardant rating) to isolate the electrical circuit 200 should an electrical fire ensue. In embodiments, the base 302 and the cover 308 may be formed from a material having a UL 746C rating of F1 (e.g., outdoor suitability rating) to mitigate damage caused by ultraviolet light over time, such as discoloration, cracking, crazing, brittleness, etc. Although generally described as being formed from a material having 5VA and F1 ratings, it is contemplated that the material from which the cover is formed may conform to any suitable UL standard, international standard, etc. and may include any suitable property depending upon the design needs of the lighting device 10 (e.g., low smoke zero halogen, etc.). In embodiments, the casing 300 may be rated under Ingress Protection standard IEC 60529, the rating of which may be selected based upon the design needs of the lighting device 10.

Although generally described as being hollow, it is envisioned that the channel 306 may include a material disposed therein, such as a potting material, a dielectric material, a cushioning material (e.g., gel, etc.), etc. to isolate the electrical circuit 200 from moisture, dust, dirt, electromagnetic interference, shock, stress, strain, heat, other components of the lighting device 10, etc. In embodiments, the substrate 202 and/or the electrical circuit 200 may be hermetically sealed while enabling the luminaire tape 100 to maintain resilient characteristics.

Maintaining the air gap is one feature that stops LED color shift due to uncontrolled refraction or polymeric contamination of the LED's phosphor mix due to a chemical reaction. In one embodiment, silicone materials or the like can be poured or injected into the void or channel 306 to hermetically seal this cavity without causing negative effects on the phosphor and/or refraction. This fill could take place after addition of the connector 400 and could happen through a jet valve hole or vacuum pump hole in the connector and/or endcap. In one embodiment, a vacuum pump can be applied to the non feed end (end cap) to aid with pulling the silicone potting material through the void while helping to eliminate bubbles that cause unwanted scattering of light. The combination of the jet valve and vacuum pump can be employed together.

Figure 9:
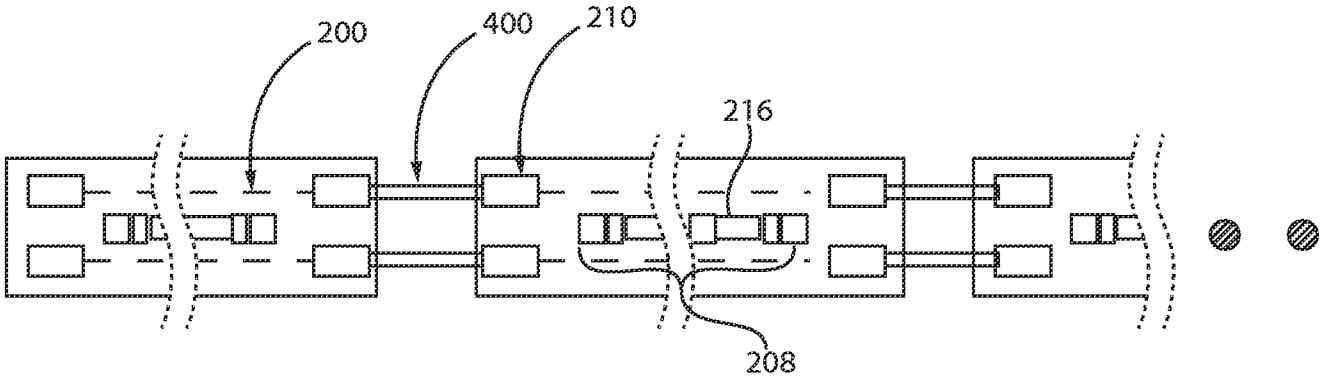
FIG. 9 is a plan view of the lighting device of FIG. 1 showing two sections of the lighting device electrically coupled by an electrical connection.
Figure 10:
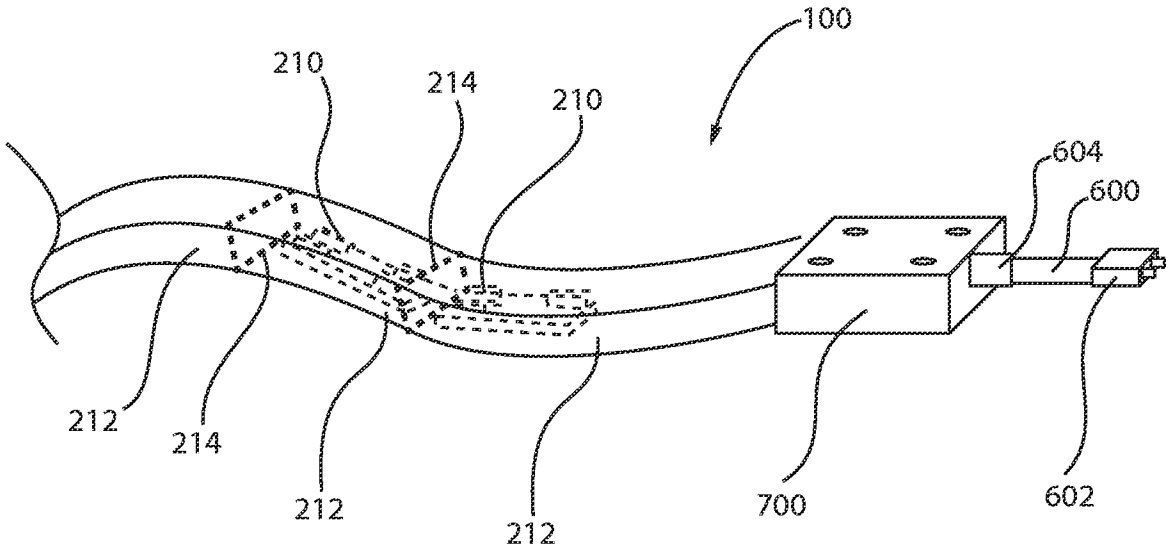
FIG. 10 is a perspective view of the lighting device of FIG. 1 showing a flexible configuration and illustrating a junction box coupled thereto.

Referring again to FIG. 1 and with additional reference to FIG. 9, each of the plurality of micro light engines 208 is substantially similar, and therefore, only one micro light engine 208 will be described in detail herein in the interest of brevity. However, it is contemplated that each of the plurality of micro light engines 208 may include the same or different number and/or type of components.

The micro light engine 208 includes a plurality of LEDs 216 in electrical communication with a suitable power supply (not shown) and current regulator (not shown) which cooperate to drive and/or regulate the plurality of LEDs 216. The micro light engine 208 is in electrical communication with the bus 206, which in turn, supplies electrical power to the plurality of LEDs 216. As can be appreciated, the micro light engine 208 may include a suitable rectifier and/or step-down transformer (not shown) to convert the AC power provided by the AC bus to DC power that is usable by the plurality of LEDs 216.

The plurality of LEDs 216 may be any suitable LED capable of being utilized with the substrate 202 and the printed circuit 204, such as a surface mount LED, other type LED, an Organic LED (OLED), etc. and capable of producing the power output and color characteristics of the luminaire tape 100 described hereinabove. Although generally described herein as being driven by DC power, it is contemplated that the plurality of LEDs 216 may be AC-driven LEDs or combinations of DC-driven and AC-driven LEDs. It is contemplated that the plurality of LEDs 216 may be wired in series or in parallel with one another depending upon the design needs of the lighting device 10. As can be appreciated, the number of LEDs 216 utilized within each micro light engine 208 may be varied depending upon the design needs of the lighting device 10, and in embodiments, may be limited by a forward DC voltage drop of the plurality of LEDs 216. Each LED of the plurality of LEDs 216 is disposed in spaced relation to one another, and in embodiments, is disposed at a distance of between one half of an inch and two inches, although any suitable spacing may be utilized depending upon the design needs of the lighting device 10.

In embodiments, one or more of the plurality of LEDs 216 may include lighting effects, such as blinking, sequential lighting, altered intensities, etc. It is contemplated that the plurality of LEDs 216 may each include the same intensity, same lighting effect, or may include different intensities, lighting effects, or combinations thereof. In one non-limiting embodiment, one or more of the plurality of LEDs 216 is in electrical communication with a dimmer circuit (not shown), which may be manually adjusted or may be adjusted remotely using a suitable controller in communication with a wireless network or the like.

Turning now to FIGS. 10-14, the lighting device 10 includes an electrical cord 600 and a junction box 700 in electrical communication with the luminaire tape 100. The electrical cord 600 may be any suitable AC or DC power cord having an electrical connector 602 operably coupled thereto. It is contemplated that the electrical connector 602 may be any suitable electrical connector configured to be used with a standard electrical outlet, such as a National Electrical Manufacturers Association (NEMA) 1-15, NEMA 5-15, NEMA 5-20, etc. depending upon the design needs of the lighting device 10. The electrical cord 600 includes a strain relief 604 disposed thereon at an opposite end portion thereof from the electrical connector 602. The strain relief 604 is operably coupled to a portion of the junction box 700 and may be integrally formed with the electrical cord 600 or may be secured thereto using any suitable means. Although generally described as being an electrical cord, it is contemplated that the electrical cord 600 may be a field installed wire, cable, conduit, etc., such as nonmetallic cable (e.g., Romex®, etc.), Armored cable (e.g., BX Electrical Cable), conduit (metallic, non-metallic, flexible, etc.), electrical metallic tubing (EMT), or the like.

The junction box 700 is operably coupled to the electrical cord 600 and the luminaire tape 100 via a terminal block 702, which may be any suitable electrical connector capable of selectively coupling one or more electrical wires thereto, such as a poke in connector, a screw terminal, etc. The junction box 700 is configured to be selectively coupled to the electrical cord 600 using any suitable method, such as fittings, connectors, crimp, clamping, etc. The junction box 700 is operably coupled to the luminaire tape 100 using any suitable method, such as fittings, connectors, crimp, clamping, etc. The luminaire tape 100 may be electrically coupled to the terminal block 702 using one or more electrical wires 400 that are electrically coupled to a respective one or more connector blocks 210 of the luminaire tape 100. In this manner, a user may operably couple a desired length of the luminaire tape 100 to an electrical power source, such as the electrical cord 600 in the field without the need for proprietary tools, as will be described in further detail hereinbelow.

Although generally illustrated as having a clam shell type configuration, it is contemplated that the junction box 700 may include any suitable configuration capable of mechanically coupling a portion of the electrical cord 600 and a portion of the luminaire tape 100 thereto as well as electrically coupling the electrical cord 600 to the luminaire tape 100.

Figure 13:
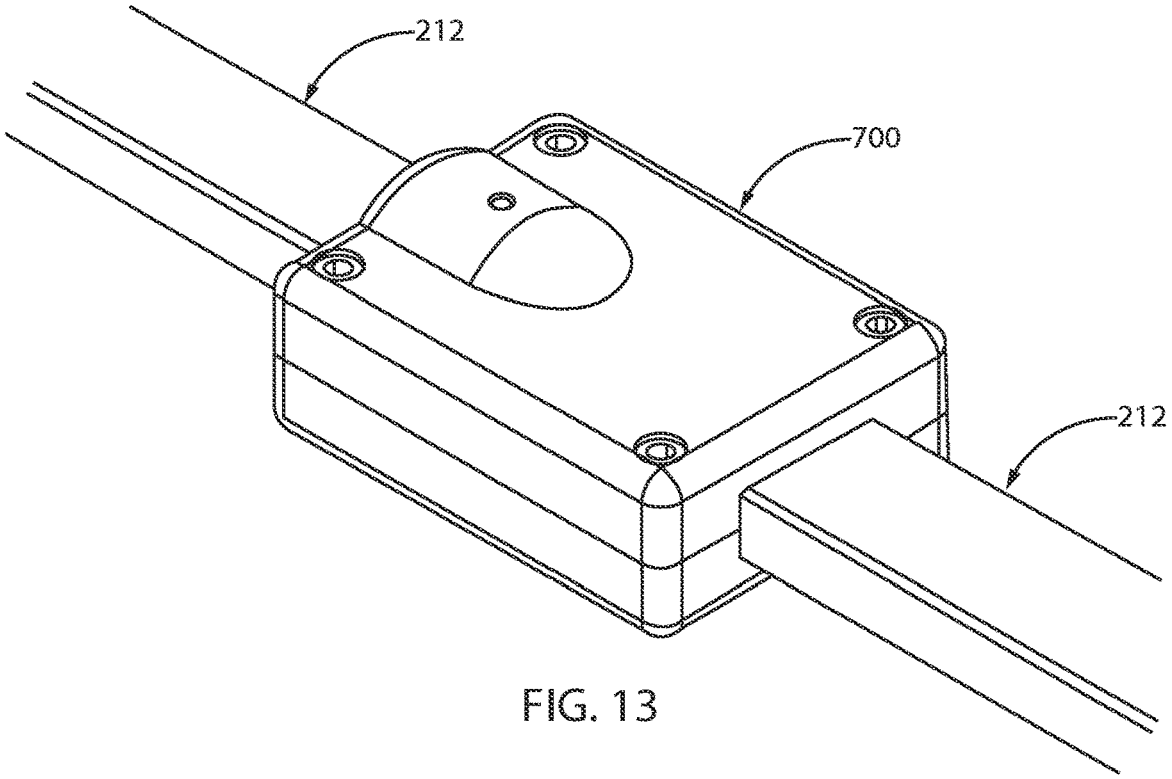
FIG. 13 is a perspective view of the junction box of FIG. 12 showing two sections of luminaire tape of the lighting device of FIG. 1 coupled thereto.
Figure 14:
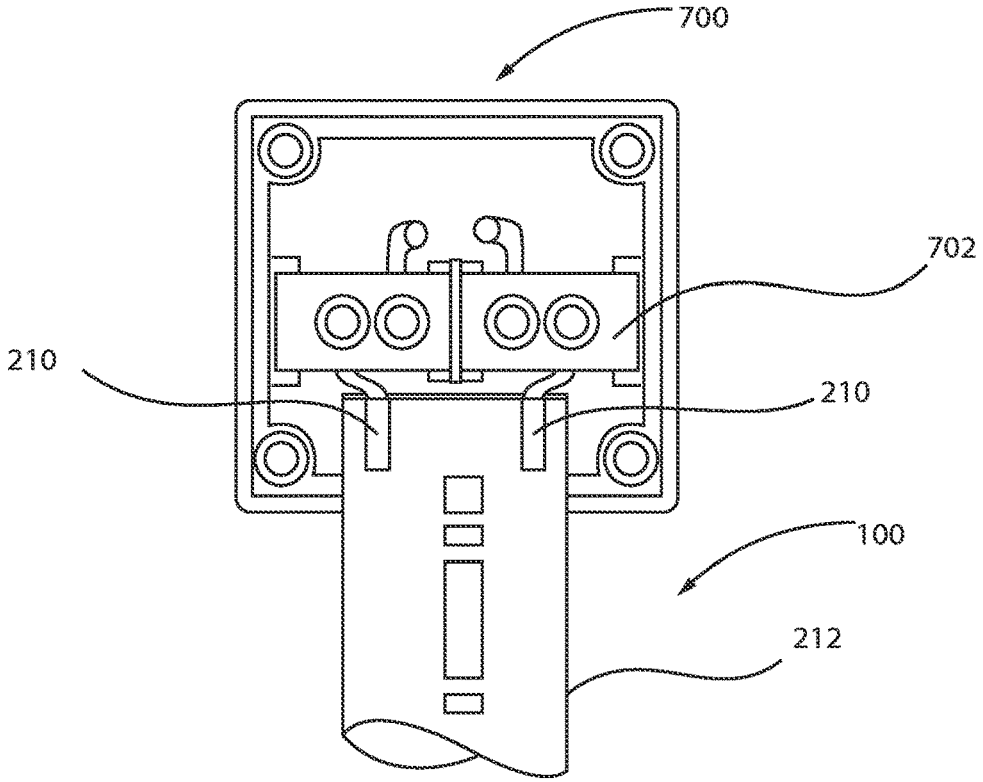
FIG. 14 is a plan view of the junction box of FIG. 12 illustrating the electrical connection between the lighting device of FIG. 1 and the junction box of FIG. 12.
Figure 15:
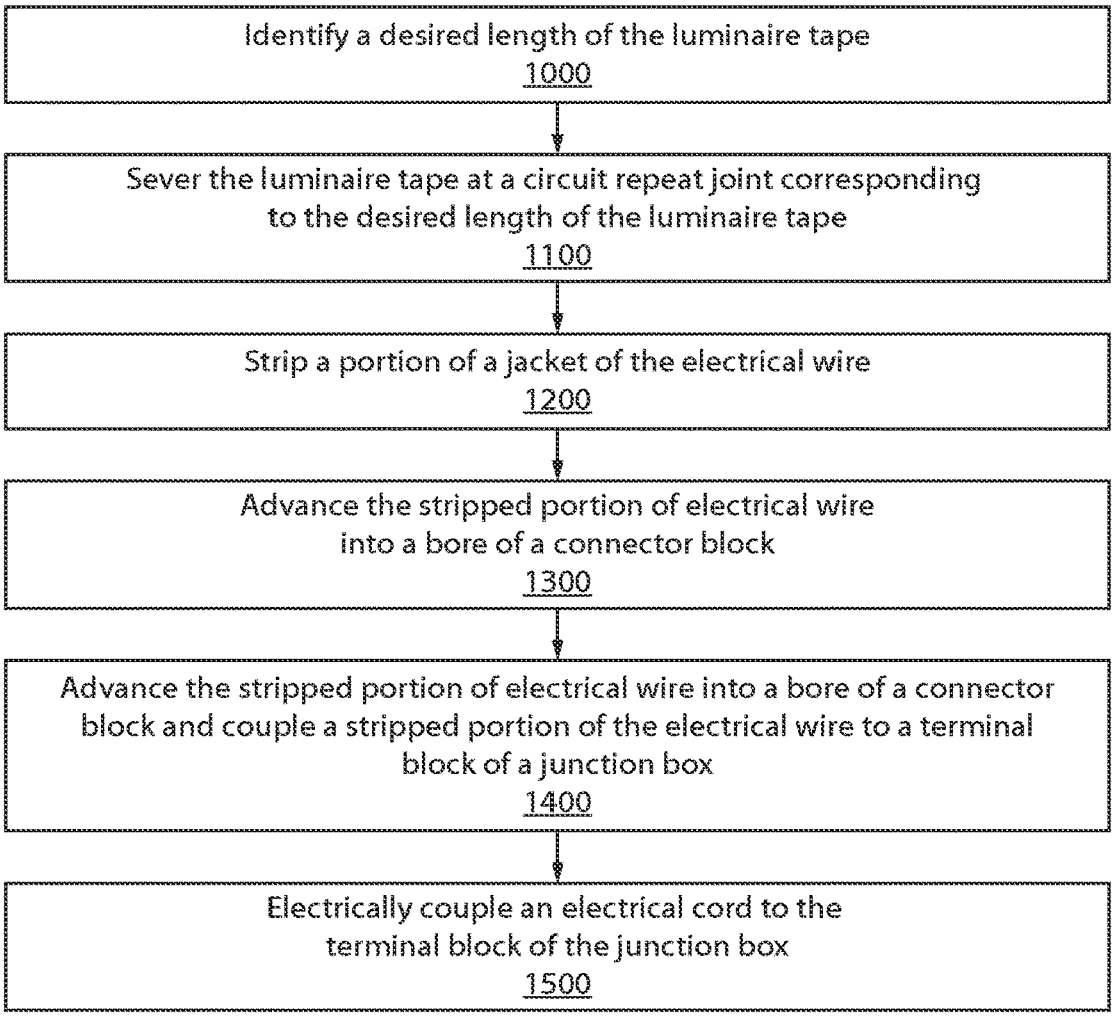
FIG. 15 is a flow chart of a method of using the lighting device of FIG. 1.
Figure 16:
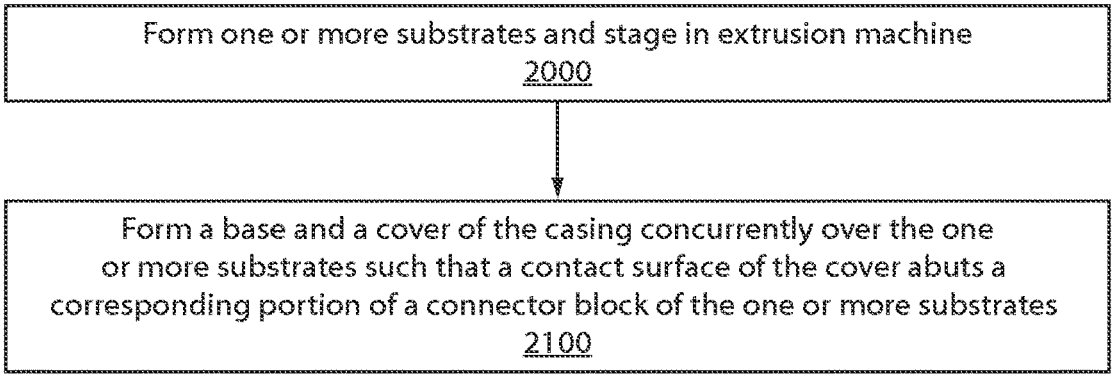
FIG. 16 is a flow chart of a method of manufacturing the lighting device of FIG. 1.

In embodiments, the junction box 700 may be operable coupled to two sections 212 of the luminaire tape 100 (FIG. 13). In this manner, rather than coupling the electrical cord 600 to the junction box 700, a second section 212 of luminaire tape 100 may be coupled to the junction box 700. It is envisioned that the junction box 700 may be a 90-degree junction box or other similar junction box capable of being used in locations requiring a change in direction or the like.

Figure 11:
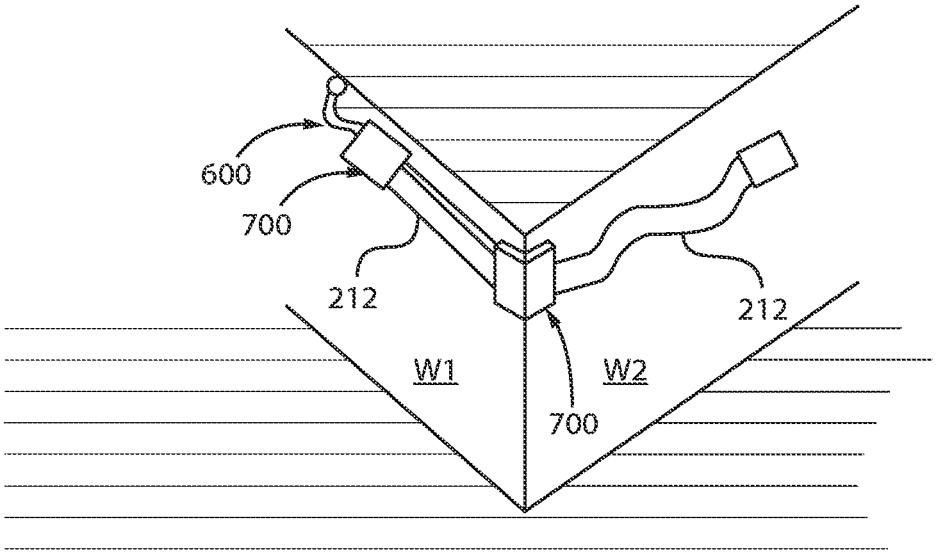
FIG. 11 is a perspective view of the lighting device of FIG. 1 showing two sections of the lighting device electrically coupled by an electrical connection around a corner.
Figure 12:
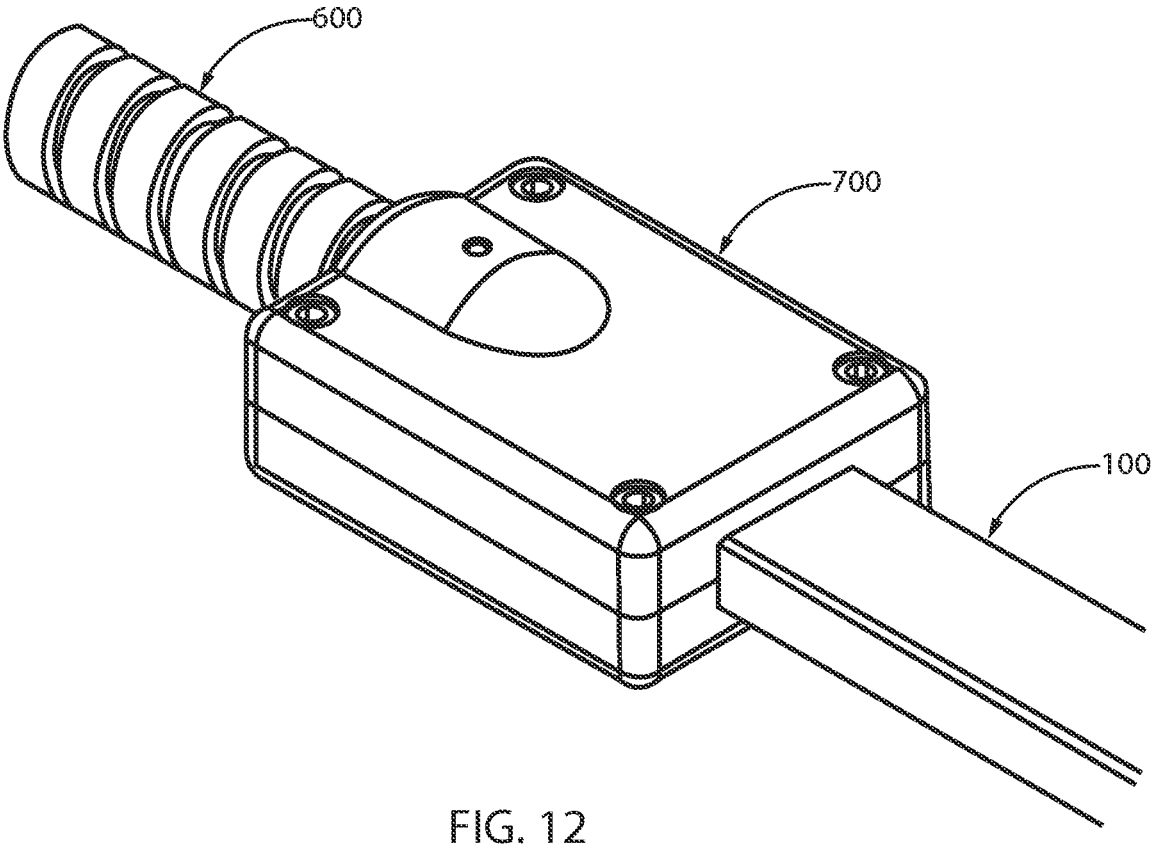
FIG. 12 is a perspective view of a junction box provided in accordance with the present disclosure for use with the lighting device of FIG. 1 showing a section of luminaire tape of the lighting device of FIG. 1 and a power cord of the lighting device of FIG. 1 coupled thereto.

As illustrated in FIG. 11, it is contemplated that multiple sections 212 of the lighting device 10 may be connected via an electrical wire 400, junction box 700, or the like around corners or other difficult to navigate configurations. In this manner, the luminaire tape 100 may be separated at a circuit repeat joint 214 to expose respective connectors of the plurality of connectors 210 disposed on each portion of the separated sections 212. A first section 212 of the luminaire tape 100 may be located on one surface of a wall "W 1" whereas a second section 212 of the luminaire tape 100 that has been separated at a circuit repeat joint 214 may be located on a second surface of a wall "W2" around a corner thereof. The first and second sections 212 of the luminaire tape 100 may be electrically connected via a junction box 700 having a 90-degree configuration. In embodiments, the first section 212 of the luminaire tape 100 may be coupled to a first junction box 700 disposed on the first surface of the wall "W1", which is coupled to a first end portion of an electrical cord, BX Electrical Cable, nonmetallic sheathed cable, etc. A second end portion of the electrical cord, BX Electrical Cable, nonmetallic sheathed cable, etc. may be coupled to a second junction box 700 disposed on the second surface of the wall "W2", that is coupled to the second section 212 of the luminaire tape 100. It is envisioned that the two sections 212 of the luminaire tape 100 may be coupled via a pair of electrical wires 400 that are selectively coupled to each respective exposed connector 210 of the first and second sections 212 of the luminaire tape 100.

With reference to FIGS. 1-15, a method of using the lighting device 10 is illustrated. Initially, in block 1000, a desired length of the luminaire tape 100 is identified. In block 1100, the luminaire tape 100 is severed at a corresponding circuit repeat joint 214 to expose respective connector blocks of the plurality of connector blocks 210. In block 1200, a portion of an insulating jacket of the electrical wire 400 is stripped to expose a portion of an electrical conductor such that the exposed portion of the electrical conductor may, in block 1300, be advanced within the bore 234 of each corresponding exposed connector block of the plurality of connector blocks 210 to electrically couple each severed section 212 of the luminaire tape 100. Alternatively, or additionally, in block 1400, an exposed portion of an electrical conductor may be electrically coupled to a respective connector block 210 at a first end portion thereof and electrically coupled to a terminal block 702 of a junction box 700. In block 1500, an electrical cord 600 may be electrically coupled to the terminal block 702 of the junction bock 700 and in block 1600, the junction box 700 may be closed using a cover or other suitable device to mechanically couple the electrical cord 600 and a portion of the luminaire tape 100 thereto. As can be appreciated, the junction box 700 may be electrically and mechanically coupled to an electrical cord 600, nonmetallic cable, BX Electrical Cable, Conduit, etc. using any suitable method. As can be appreciated, this method may be repeated as many times as necessary and the various blocks described herein may be performed in any order except as explicitly stated otherwise.

With reference to FIGS. 1-14 and 16, a method of manufacturing the lighting device 10 is illustrated. Initially, in block 2000, one or more substrates 202 including electrical circuits 204 and electrical connectors 210 disposed thereon are formed and electrically coupled together. In block 2100, the base 302 or first extrusion, and the cover 308 or second extrusion are concurrently formed over the one or more substrates 202 such that the cover 308 is formed within the channel 306 of the base 302. During formation of the base 302 and the cover 308, the lower surface 312, and in embodiments, the center surface 318, is formed such that a portion of the lower surface 312 abuts a corresponding portion of each connector block 210 to inhibit movement of the plurality of connector blocks 210 relative to the substrate 202 thereby providing mechanical support, and inhibiting damage, to a joint formed between each connector block 210 and a portion of the substrate 202. As can be appreciated, and as noted hereinabove, it is contemplated that the base 302 and the cover 304 may be formed at separate times. As can be appreciated, this method may be repeated as many times as necessary.

It is envisioned that the various components disclosed herein may be provided in the form of a kit. The kit may include one or more lighting devices 10 and one or more electrical wires 400 or one or more sections of electrical wires 300. In embodiments, the kit may include a lighting device 10 having a substrate 202, having a rigid substrate 502, or combinations thereof.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A lighting device, comprising:
- a substrate;
- an electrical circuit operably coupled to the substrate;
- a connector block operably coupled to the substrate and in electrical communication with the electrical circuit; and
- a casing disposed over the substrate, the electrical circuit, and the connector block, a portion of the casing defining a contact surface, the contact surface and a portion of the substrate defining a cavity therebetween, wherein a portion of the contact surface of the casing abuts a corresponding portion of the connector block to provide mechanical support to a joint formed between a portion of the connector block and a portion of the substrate.

2. The lighting device according to claim 1, wherein the connector block is a poke in connector.

3. The lighting device according to claim 1, wherein the casing includes:
- a first extrusion formed to encapsulate at least a portion of the substrate, the first extrusion forming a channel; and
- a second extrusion formed within the channel, the second extrusion defining the contact surface.

4. The lighting device according to claim 3, wherein the contact surface of the second extrusion defines an arcuate profile.

5. The lighting device according to claim 3, wherein the first extrusion is formed over the portion of the substrate before the second extrusion is formed within the channel of the first extrusion.

6. The lighting device according to claim 3, wherein the first extrusion and the second extrusion are formed concurrently.

7. The lighting device according to claim 1, further including a second connector block operably coupled to the substrate and in electrical communication with the electrical circuit, the second connector block disposed in spaced relation relative to the connector block.

8. The lighting device according to claim 1, wherein the substrate is a flexible substrate.

9. The lighting device according to claim 8, further including a second connector block operably coupled to the flexible substrate and in electrical communication with the electrical circuit, wherein a respective portion of the contact surface of the casing abuts a corresponding portion of each of the connector block and the second connector block to provide mechanical support to a joint formed between a portion of the connector block and a portion of the flexible substrate during flexing of the lighting device.

10. The lighting device according to claim 1, further including:
- a second substrate;
- a second electrical circuit;
- a second connector block operably coupled to the second substrate and in electrical communication with the second electrical circuit;
- a second casing disposed over each of the second substrate, the second electrical circuit, and the second connector block; and
- an electrical conductor, the electrical conductor configured to be received within a portion of the first connector block at a first end portion thereof and configured to be received within a portion of the second connector block at a second end portion thereof to electrically couple the first and second electrical circuits.

11. A method of manufacturing a lighting device, comprising:
- forming a first extrusion over a portion of a substrate, the substrate including:
  - an electrical circuit operably coupled to the substrate; and
  - a connector block operably coupled to the substrate and in electrical communication with the electrical circuit; and
- forming a second extrusion within a channel, the second extrusion defining a contact surface, wherein the contact surface and a portion of the substrate define a cavity therebetween, wherein a portion of the contact surface of the casing abuts a corresponding portion of the connector block to provide mechanical support to a joint formed between a portion of the connector block and a portion of the substrate.

12. The method of manufacturing according to claim 11, wherein forming the second extrusion includes forming the second extrusion from a material that is different than a material of the first extrusion.

13. The method of manufacturing according to claim 11, wherein forming the second extrusion includes forming an arcuate profile on the contact surface, wherein a portion of the arcuate profile of the inner surface abuts a corresponding portion of the connector block.

14. The method of manufacturing according to claim 11, wherein forming the second extrusion includes forming the second extrusion after forming the first extrusion.

15. The method of manufacturing according to claim 11, wherein forming the second extrusion includes forming the second extrusion concurrently with the first extrusion.

16. A method of using a lighting device, comprising:

identifying a desired length of an electrical circuit;

severing the electrical circuit at a circuit repeat joint operably coupled to the electrical circuit corresponding to the desired length, at least a portion of each severed portion of the electrical circuit encapsulated by a first extrusion forming a channel;

electrically coupling a respective connector block operably coupled to each of the severed electrical circuits to electrically couple each of the severed electrical circuits across a gap defined therebetween, each connecting block defining a bore therethrough; and mechanically supporting at least one connector block using a second extrusion formed within the channel.

17. The method according to claim 16, wherein electrically coupling a respective connector block includes the connector block being a poke in connector.

18. The method according to claim 16, further including electrically coupling a second connector block operably coupled to one of the severed electrical circuits to a portion of a junction box to electrically couple the severed electrical circuits to the junction box.

19. The method according to claim 16, wherein mechanically securing the at least one connector block includes a contact surface defined on the second extrusion abutting a portion of the at least one connector block to provide mechanical support to a joint formed between a portion of the connector block and a portion of the electrical circuit.

20. The method according to claim 16, wherein identifying the desired length of the electrical circuit includes the electrical circuit having a flexible substrate, wherein the at least one connector block is operably coupled to the flexible substrate.

* * * * *